United States Patent [19]

Miles

[11] 4,332,153

[45] Jun. 1, 1982

[54] DUAL KEY LOCKS WITH MULTI-FUNCTION TUMBLERS

[76] Inventor: James M. Miles, 1511 E. Edinger, Santa Ana, Calif. 92705

[21] Appl. No.: 45,124

[22] Filed: Jun. 4, 1979

[51] Int. Cl.[3] ..... E05B 35/12

[52] U.S. Cl. ..... 70/339; 70/355; 70/385

[58] Field of Search ..... 70/355, 339, 382, 383, 70/384, 385, 337

[56] References Cited

U.S. PATENT DOCUMENTS

| | | | |
|---|---|---|---|
| 1,148,282 | 7/1915 | Benham | 70/339 |
| 3,127,759 | 4/1964 | Ellis | 70/339 |
| 4,072,032 | 2/1978 | Phillips | 70/339 |

*Primary Examiner*—Robert L. Wolfe

*Attorney, Agent, or Firm*—Charlton M. Lewis

[57] ABSTRACT

The invention provides an improved lock configuration by which a dual key lock can operate efficiently and conveniently with a single stack of tumblers. That configuration permits more accurate positioning of the tumblers upon key operation, whereby a larger number of key combinations can generally be accommodated. Also, the individual tumblers of the invention are typically receivable in the lock in a plurality of alternative orientations in which their gates assume different functions. That difference of function may constitute a change of effective gate position with respect to the same key, or may shift cooperation with the two keys from one pair of gates to another. That aspect of the invention is useful in facilitating key changes, especially in locks designed for safe deposit and similar service.

16 Claims, 12 Drawing Figures

DUAL KEY LOCKS WITH MULTI-FUNCTION TUMBLERS

BACKGROUND OF THE INVENTION

This invention has to do with locks, and relates especially to locks that require two keys for their operation, as is typically true, for example, in locks for safe deposit boxes and similar applications.

Locks of that general type ordinarily require a correspondingly large number of parts, making them relatively expensive to manufacture and service. In particular, if each key drives a distinct and independent set of tumblers the number of moving parts in the lock may approach twice that required in a single-key lock.

Many presently available dual-key locks employ two sets of pivoted tumblers each of which is independently operated by one of the keys. In such locks the radial length of the tumblers is severely limited by the conventional size of the lock housing. That shorter tumbler length increases the angle through which the tumbler must swing for any given bit height of the key, increasing correspondingly the range of angles at which the key engages the various tumblers in bolt-releasing position. That increased range of working angles between key and tumbler tends to reduce accuracy, limiting the number of different key configurations that can be provided with a given number of tumblers.

It has also been proposed to construct a dual key lock with a single stack of floating tumblers which are engaged by the two keys at spaced positions along their length. That concept is disclosed, with a variety of auxiliary features, in a series of patents by Roy T. Ellis, of which U.S. Pat. No. 3,127,759 is illustrative. However, the tumblers of Ellis' single stack are of complex shape and require numerous auxiliary levers and secondary tumblers for their operation. Moreover, the gate positions on each tumbler's primary working edge must take account of the bit height of both the keys. Thus, if the key combination is to be changed by replacing one set of tumblers by a set corresponding to a new pair of keys, a very large number of different tumbler forms must be kept on hand. If key A has six bit heights, for example, and key B has eight, the possible key combinations may involve 48 different positions of the primary gate, all of which must be available if all possible combinations are to be provided. In contrast, the more conventional locks with two independent stacks of tumblers involve only six gate configurations for one tumbler and eight for the other, or a total of 14 species. The increased complexity and expense of the Ellis lock in changing keys is evident.

SUMMARY OF THE INVENTION

The present invention provides dual key locks which combine remarkable simplicity of basic form with improved accuracy of operation. The locks of the invention typically require no more parts, aside from the obvious need for two key noses, than the most rudimentary of single key locks having the same number of teeth per key. The structure of the invention permits the keys to position the lock tumblers with such accuracy that it becomes feasible to provide an increased number of bit heights within a given range of radial key dimensions. Thus a larger number of combinations can be provided with a given number of key teeth; or a given number of combinations can be made available with fewer key teeth, and hence with correspondingly fewer tumblers, leading to further reduction of the number of parts without loss of performance.

The invention further facilitates required key changes when that is done by replacing one or more tumblers by tumblers having different gate positions. The invention reduces the number of different tumblers that must be kept on hand for carrying out such changes. Both the capital and labor cost of key changes are thereby reduced.

Those and other advantages of the invention are attained by employing a single stack of elongated tumblers which are movable laterally primarily in translation and have two gated transverse blocking edges adapted to cooperate with respective fence lugs, typically mounted directly on the bolt. The tumblers are laterally positioned by dual keys working at longitudinally spaced points of the tumblers, which points are in principle directly opposite the respective blocking edges. That simple configuration has been found to permit each key to act accurately and reliably to bring the corresponding gates into alignment to release the corresponding fence lug entirely independently of the action of the other key.

A further aspect of the present invention is the discovery that the described independence of function of the two keys permits the tumblers to be designed with such symmetry that each one can be installed in the lock in up to four alternative orientations, each such orientation corresponding to a different combination of bit heights on the two keys. More particularly, symmetry of each tumbler with respect to a transverse axis permits two alternative working orientations which are derivable from each other by inverting the tumbler about that axis; and two-fold tumbler symmetry, with respect to a transverse axis and also with respect to a longitudinal axis, permits four alternative working orientations for each tumbler. Since each tumbler can provide four different key combinations, the number of different tumbler configurations required to make up any desired number of combinations is typically reduced by a factor of four.

In preferred form of the invention each tumbler comprises a generally rectangular flat plate with a transverse guide slot midway of its length and two transverse control slots equally spaced on opposite sides of the guide slot. Both side edges of both control slots are provided with one or more gates at selected positions. A fixed pin is slidably received in the guide slots of all tumblers, and two fence lugs carried by the bolt project through the respective control slots.

The control and guide slots, and the laterally facing tumbler edges which are engaged by the two keys, are formed symmetrically with respect to both a transverse and a longitudinal axis. Each tumbler can then be received in the lock with either end forward, and with either face directed toward the cover plate. The gates, however, are normally positioned unsymmetrically. Inversion of a tumbler then typically alters the effective bit height for both keys in two, or in all four, tumbler orientations.

It will be noted that in any tumbler orientation the locking action for the forward key is always controlled by the gate on an inner slot edge, that is, the edge nearest the center of the tumbler; while the active gate for the rearward key is on an outer slot edge. Thus, distinct gates cooperate with the forward and rearward keys. Inversion of a tumbler about a longitudinal axis causes the effective position of each active gate to be measured from the opposite tumbler side edge.

BRIEF DESCRIPTION OF THE DRAWING

A full understanding of the invention, and of its further ojbects and advantages, will be had from the following description of certain illustrative manners of carrying it out. The particulars of that description, and of the accompanying drawings which form part of it, are intended only as illustration and not as a limitation upon the scope of the invention, which is defined in the appended claims.

In the drawings.

DESCRIPTION OF PREFERRED EMBODIMENT

Figure 1:
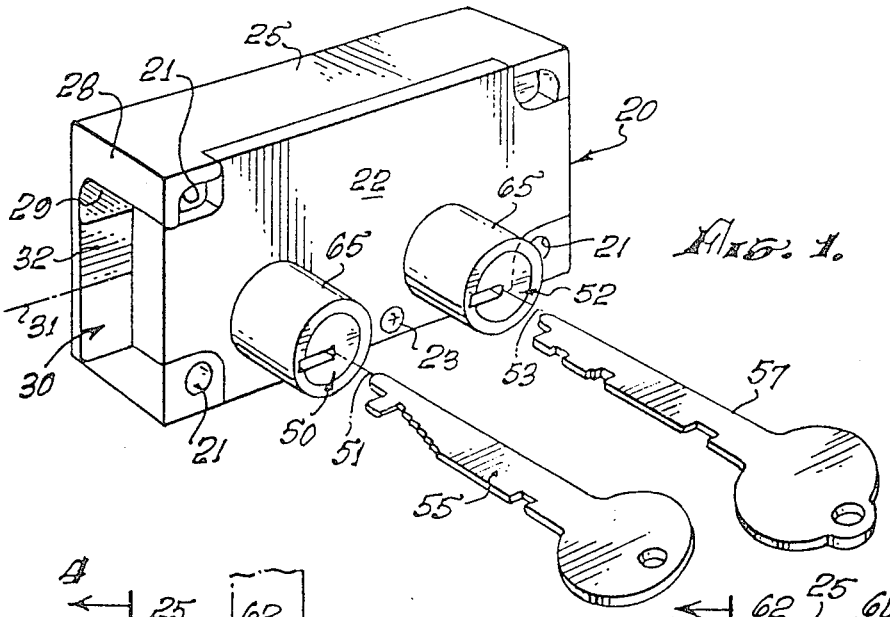
FIG. 1 is a perspective representing an illustrative lock in accordance with the invention in its normal orientation.
Figure 2:
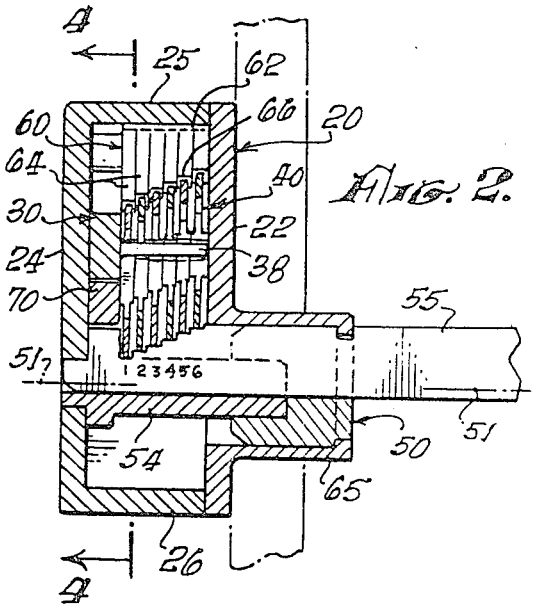
FIGS. 2 and 3 are vertical transverse sections on the respective lines 2—2 and 3—3 of FIG. 4.
Figure 3:
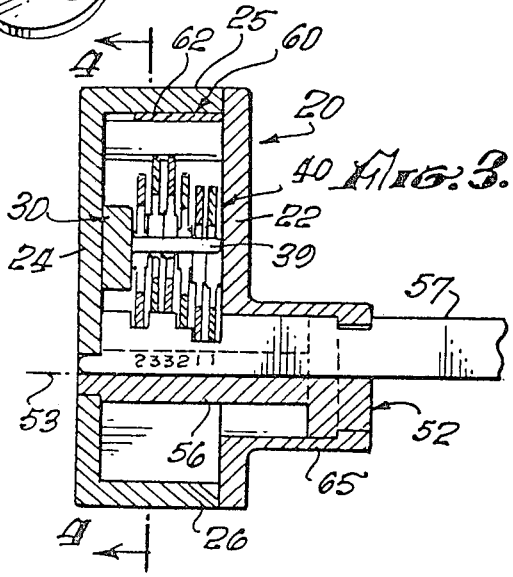

The illustrative lock shown in the drawings comprises the case 20, typically of conventional construction and size, with the cover plate 22. The lock is ordinarily installed in the orientation shown in FIGS. 1 to 6 with the outer face of cover plate 22 against the inside surface of the door that is to be locked, not explicitly shown. The mounting posts at the case corners facilitate such mounting, as by screws in the bores 21. Since the cover plate is retained securely when the lock is so mounted, only the single screw 23 is typically provided for holding the cover when the lock is removed, as for servicing. For clarity of description, the lock will be assumed to be in its normal orientation, but without implying any limitation to such use.

Figure 4:
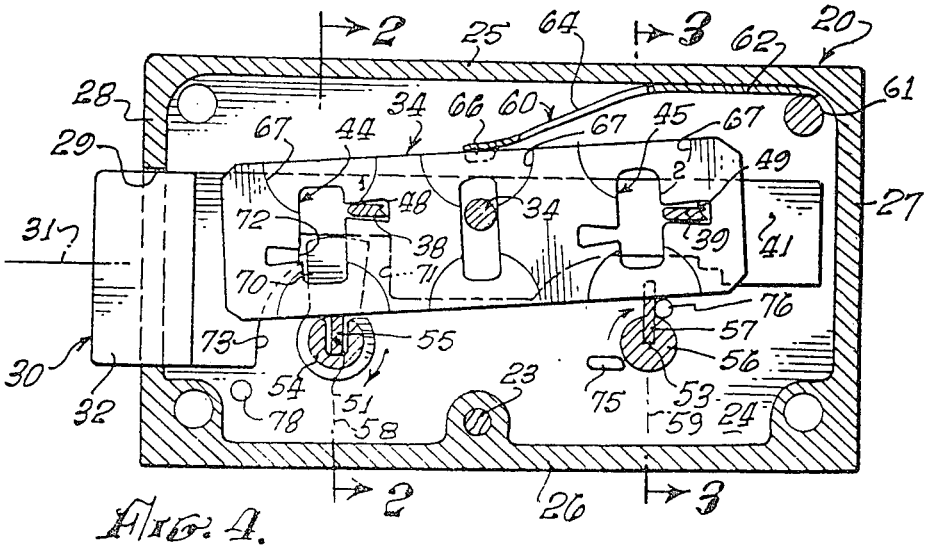
FIG. 4 is a vertical longitudinal section on the lines 4—4 of FIGS. 2 and 3 and showing the lock in released position.

Case 20 includes the rectangular back wall 24, the upper and lower side walls 25 and 26, the rearward end wall 27 and the forward end wall 28. The bolt 30 is mounted in case 20 for sliding movement along the bolt axis 31, which is parallel to the length of the case. The bolt is typically guided in that movement by case back wall 24, by sliding fit of its thickened forward working end 32 in the rectangular aperture 29 in case front wall 28, and by the pin 34 which projects rigidly and perpendicularly from case back wall 24 and is slidingly received in the longitudinal slot 36 in the bolt. That slot defines the range of bolt movement between its forward, projecting locking position (FIGS. 1 and 5) and its rearward, retracted releasing position (FIG. 4). The bolt is provided with the two upstanding fence lugs 38 and 39, which are typically of like form and are spaced longitudinally of the bolt forward and rearward, respectively, of guide slot 36.

The tumblers 40 are slidably mounted in a stack between the flat upper face of bolt 30 and the inner face of cover plate 22. They are guided in their sliding movement by pin 34, which is slidingly received in the transverse slot 42 of each tumbler. Guide slot 42 is perpendicular to the longitudinal tumbler axis 41 and positively defines the position of each tumbler along bolt axis 31. The tumblers also have two transverse control slots 44 and 45, equally spaced forwardly and rearwardly, respectively, from guide slot 42. In locking position of the bolt, as in FIG. 5, tumbler control slots 44 and 45 freely receive the respective bolt fence lugs 38 and 39, normally blocking bolt movement toward releasing position.

The two key noses 50 and 52 are mounted in case 20 laterally adjacent the lower edge of the tumbler stack and mutually spaced longitudinally of the tumblers. The key noses typically comprise the core members 54 and 56, which are journaled on the key axes 51 and 53 in aligned bores in back wall 24 and in cover plate 22. The cores project through the cover plate within the protective collars 65, and are thus accessible from outside the door on which the lock is mounted. The cores are slotted in conventional manner to receive their respective keys 55 and 57, which are rotatable with the nose cores between generally horizontal bolt locking positions (FIG. 5) and generally vertical bolt releasing positions (FIG. 4).

Figure 5:
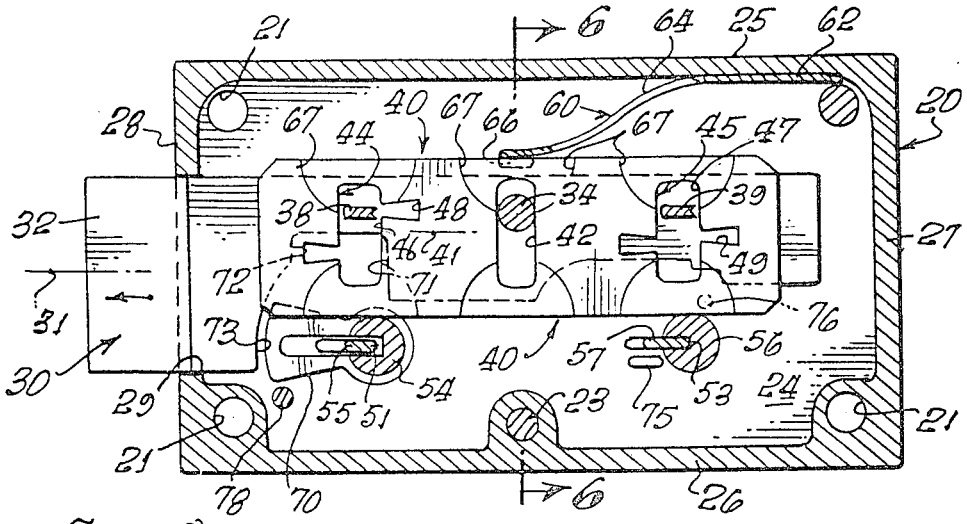
FIG. 5 is a section corresponding to FIG. 4 and showing the lock in locked position.
Figure 6:
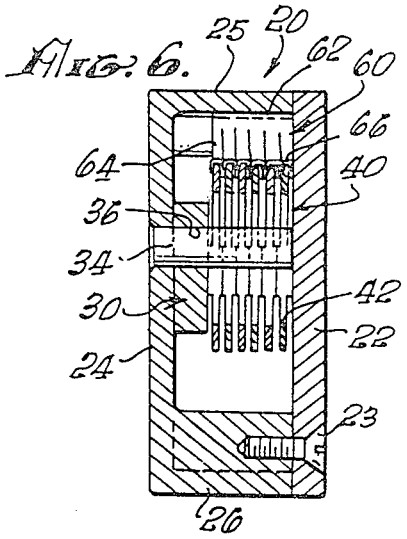
FIG. 6 is a vertical transverse section on the line 6—6 of FIG. 5.

Tumblers 40 are individually biased laterally toward the two key noses by spring means which may be of any suitable type. As illustratively shown, the unitary spring 60 comprises the base portion 62, typically mounted between top case wall 25 and the fixed post 61, and the individual spring arms 64. Each arm is provided with a tumbler-engaging finger structure 66 of U-section adapted to embrace the upper edge of a tumbler approximately midway of its length, where the tumbler plate is thinned by coining 67, as shown in FIG. 5. The resulting downward force on each tumbler maintains its lower edge in light contact with both key noses when the keys are in bolt locking positions. As the keys are rotated clockwise to bolt releasing positions each tumbler is lifted by the key teeth to a definite elevated position, slightly compressing the respective spring arms.

Control slots 44 and 45 of each tumbler are provided on their rearward edges 46 and 47 with gate apertures 48 and 49. Those gates are just wide enough to receive the fence lugs, and are positioned laterally of each tumbler in accordance with the various bit heights of the corresponding key. Clockwise rotation of both keys to their bolt releasing positions thus lifts each of the tumblers a distance just sufficient to align the gates with the respective fence lugs 38 and 39. The bolt is thus released from the blocking action of the tumblers at both the forward and rearward control slots 44 and 45.

One of the two key noses, shown typically as forward nose 50, is provided with a lever 70 for engaging the bolt faces 71 and 72 to drive bolt 30 between its locking and releasing positions in response to rotation of the associated key. As illustratively shown, the bolt releasing face 71 is engaged by lever 70 as key 55 reaches its bolt releasing position. Continued key rotation through a small angle drives the bolt to its fully retracted position, defined by pin 34. Counterclockwise key rotation then causes lever 70 to engage the second bolt drive face 72, driving the bolt forward. The lever slips off face 72 as the bolt reaches its locking position. The key is then free to return to its normal locked position, with lever 70 opposite the arcuate clearance surface 73 on the bolt, positively blocking the latter from release movement.

The key nose with which bolt drive lever 70 is associated is normally operated to releasing position only after the other key nose has been so operated. Thus, in the present instance, key 57 is operated first. Its bolt locking and releasing positions are defined by the respective stops 75 and 76. Bolt locking and releasing positions of key 55 are defined via lever 70 by the stop 78 and by the action of pin 34 in limiting bolt movement.

The longitudinal positions of the two key noses along bolt axis 31 are such that the respective keys engage driving surfaces on the lower tumbler edges at points approximately opposite the respective tumbler control slots 44 and 45. Stating the preferred relation more precisely, each key axis 51 is directly in line with the normal position of the rearward, or active, edge of the associated control slot 44 or 45. The point of contact of each key on the lower tumbler edge when in bolt releasing position is then also approximately aligned with that active slot edge. A slight deviation from that latter relation may be caused by inclination of the tumbler when the bit height is greater for one key than for the other, as illustrated in FIG. 4. However, such inclination is in general as likely to be in one direction as the other, and its maximum value is limited by the relatively wide separation of the two key noses so that in practice its effect is completely negligible.

The defined relative location of the key noses has the important result that rotation of each key to bolt releasing position aligns the corresponding tumbler gates independently of any action by the other key. Thus, not only is the bolt fully released by operation of both keys, but operation of either key alone completes the releasing action corresponding to that key, and that action is not disturbed by later operation of the other key.

That independence of action by the two keys may be visualized more precisely from the detailed nature of the tumbler movement when one key is operated. The resulting level change at the operated key causes movement that is limited by support of the tumbler on the stationary key and by guiding action of pin 34 in tumbler guide slot 42. The resulting tumbler movement is rotation about a center of rotation which shifts with the movement but is always close to the gated edge for the stationary key. The precise locus of the center of rotation at each moment is the intersection of a line perpendicular to slot 42 at pin 34 and a line perpendicular to the tumbler edge at the stationary key. Since in practice that center of rotation is always virtually at the control slot edge, the tumbler rotation due to one key can cause no appreciable variation in gate level at the other key, thus insuring that each key functions independently of the other.

An advantage of meeting that independence condition strictly is that the lock operates in an unusually precise manner with a linear one-to-one relationship between the various bit heights of each key and the spacings of the corresponding gates along the blocking edge of the tumbler. Thus, the spacing between gate positions is directly equal to the difference between the corresponding key bit heights. That equality has been found to improve the accuracy of operation sufficiently to permit a reduction of the bit intervals. A given available range of bit heights can then accommodate a larger number of distinct bit levels and provide a correspondingly increased number of key combinations.

Figure 9:
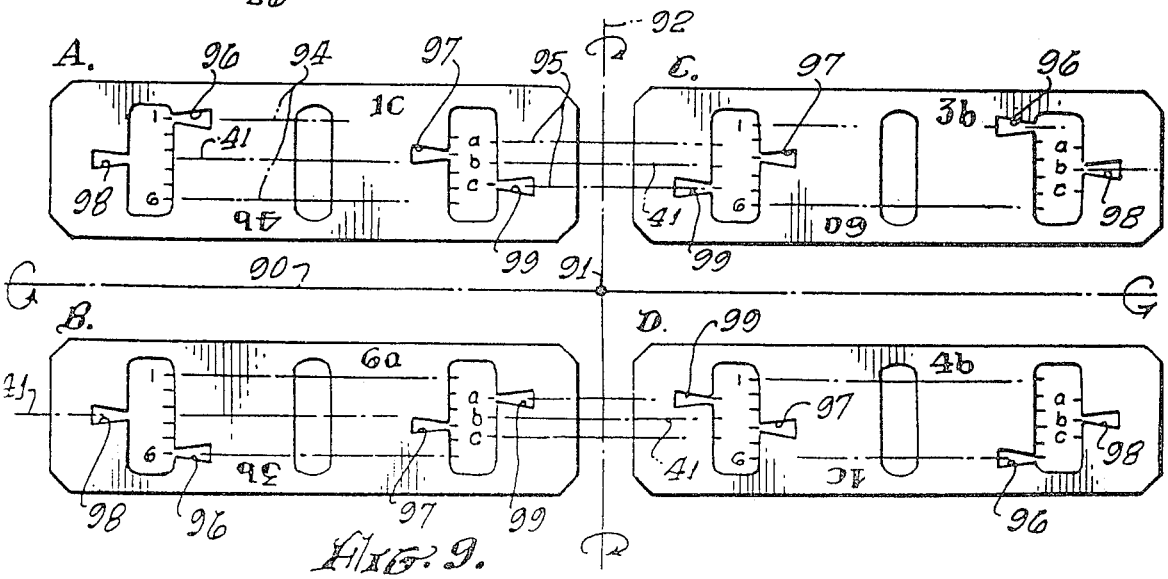
FIG. 9 is a schematic plan representing a typical tumbler in its four alternative orientations, and indicating illustrative gate positions.
Figure 7:
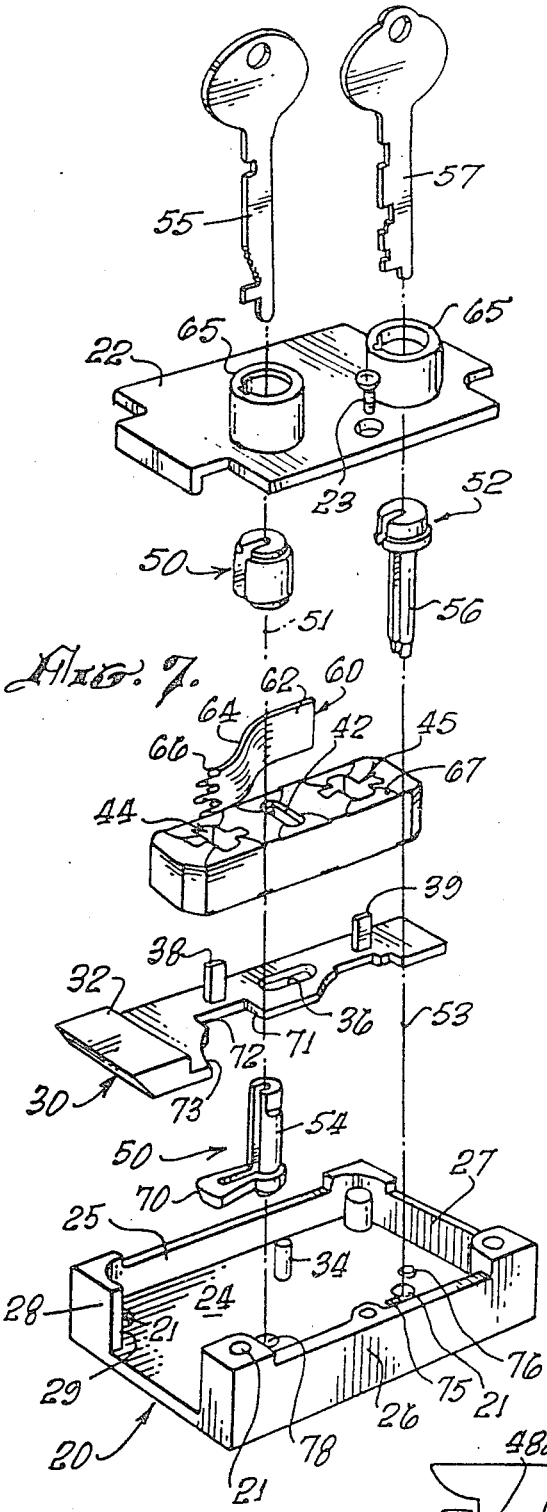
FIG. 7 is an exploded perspective corresponding generally to the preceding figures.
Figure 8:
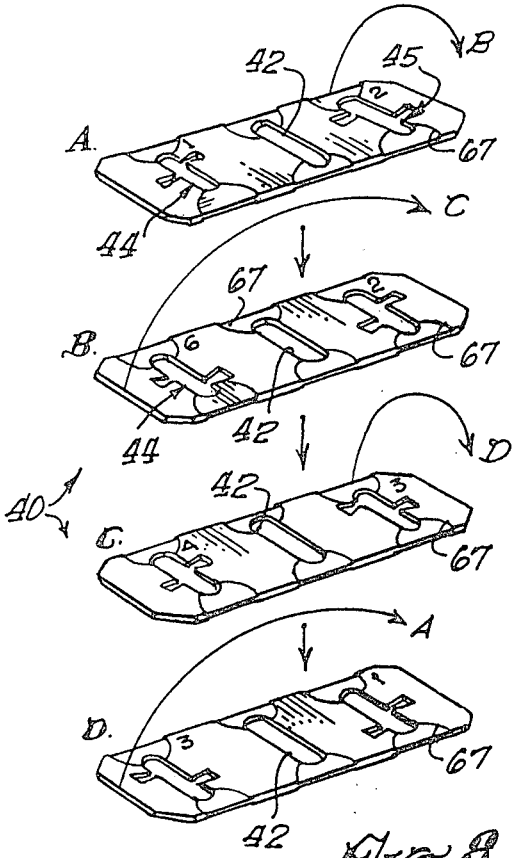
FIG. 8 is a schematic perspective representing four alternative orientations which a typical tumbler may assume in a lock.

The attainment of independent key operation with a single set of floating tumblers further permits each tumbler to assume multiple orientations in the lock, providing a correspondingly increased number of key combinations. That concept is illustrated in FIG. 9 for a tumbler with typical gate configuration. Four different tumbler orientations are designated A, B, C and D. The tumbler can be shifted from one orientation to an adjacent one by inverting it about the horizontal axis 90 or the vertical axis 92. A typical configuration of gates is shown, selected from six equally spaced gate positions for the left key, designated 1 to 6, and three gate positions for the right key, designated a, b and c. The total range of available gate positions is indicated by the lines 94 and 95 for the respective keys, considerably exaggerated for clarity of illustration. The provision of more bit positions for one key than the other may be useful, for example, when many different subscribers' keys are required, but only a smaller number of guard keys.

As seen in tumbler orientation A, the two inner gates 96 and 97, which relate to the left key, appear at positions 1 and 3, whereas the two outer gates 98 and 99 which relate to the right key, appear at positions b and c. The operative gates for the respective left and right keys are then gate 96 in position 1 and gate 99 in position c. Those positions are typically marked on the face of the tumbler in some definite relation to the respective gates, as indicated in the figure.

Inversion of the tumbler about axis 90 to orientation B shifts each of the operative gates 96 and 99 to the opposite side of the longitudinal axis of tumbler symmetry 41. The gates then assume the respective positions 6 and a, which are also marked on the tumbler face. Inversion of the tumbler about vertical axis 92 from A to C, on the other hand, moves gates 97 and 98 into operative positions for the left and right keys, respectively. The gate positions at C are thus 3 for the left key and b for the right key. The further inversion from C to D shifts operative gate 97 for the left key to the symmetrically opposite position 4; but gate 98 for the right key, being directly on axis 41, is not altered by the inversion. Orientation D can obviously be reached via B as well as via C; or directly from A by tumbler rotation in its plane about the point 91.

The invariance of gate 98 with respect to inversion between positions C and D has practical value when it is desired to change the left key without changing the right one, as when a subscribers' key is changed and a bank control key is held constant, for example. Such invariance for a gate position off the axis of symmetry may be obtained by providing the blocking edge with dual gates, symmetrically placed with respect to the axis.

With each tumbler marked clearly with the combination of key bit levels to which it corresponds in each of its four orientations, as typically indicated in FIG. 9, for example, the proper tumblers can readily be selected from a suitable stock to assemble a tumbler stack corresponding to any given pair of keys; or keys can readily be cut to correspond to any given stack of tumblers. For servicing any required number of different key combinations, the invention thus reduces by a factor of approximately four the number of distinct varieties of tumbler that must be kept in stock.

Some of the above described advantages of the invention are attainable with separate tumblers for each key. Although more items are then required for servicing a given number of key combinations, the length of each tumbler is typically reduced, which may sometimes be advantageous. As indicated illustratively in FIGS. 10 and 11, each tumbler of the previous embodiment may be replaced by two generally identical units, with suitable means for guiding their lateral movement. The tumbler units are all generally identical in shape, each one having two distinct gated blocking edges with the gates typically positioned differently along the two edges. Each tumbler is then usable alternatively for cooperating with either one of the two key noses, one blocking edge being adapted for cooperating with one key nose, the other blocking edge with the other key nose.

Figure 10:
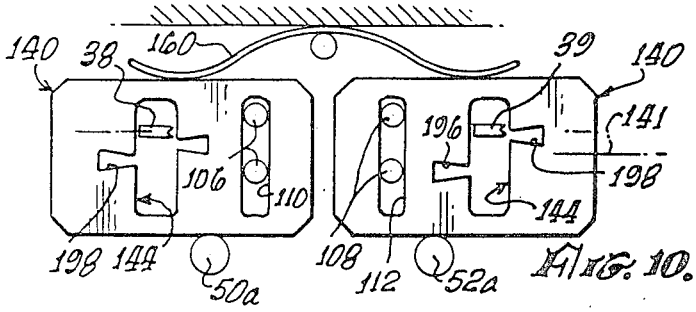
FIG. 10 is a schematic plan representing a modified form of tumbler; providing distinct tumblers for each key nose.

In FIG. 10 each of the smaller tumblers 140 is guided by the pair of fixed pins 106 or 108 working in a single transverse tumbler guide slot 110. Since the movement is then strictly translational, the key noses 50*a* and 52*a* may be placed at any convenient longitudinal position, preferably close enough to the guide slots to avoid any tendency of the guide pins to bind. A single spring element 160 may be arranged to bias all the tumblers if desired.

Figure 11:
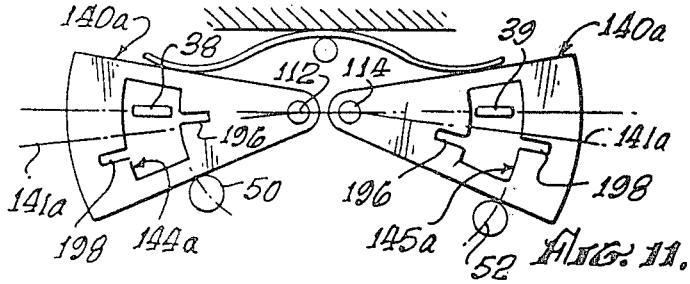
FIG. 11 is a schematic plan representing a modification of FIG. 10.

In FIG. 11 the two stacks of tumblers 140*a* are pivoted on the respective fixed pins 112 and 114 for swinging movement in response to the bias springs 60*b* and the respective key noses 50*b* and 52*b*. Control slots 144*a* are preferably curved approximately about the pivot pin as a center, and the keys engage driving edges on the tumblers that are preferably approximately radial with respect to the pivots. Both tumbler stacks can be pivoted on the same pin, if preferred, with suitable provision for interleaving, as by thinning the tumblers near the pivot.

In both FIGS. 10 and 11 the tumblers are preferably symmetrical with respect to individual longitudinal axes 141 or 141*a*. They can then be inverted about that axis; and are also insertable in the lock in position to control either one of the two fence lugs. Thus each tumbler is usable in four alternative orientations, and is typically labeled, as in the general manner previously described, to indicate the gate positions that are active in each orientation. As in the first described embodiment lug 38 is controlled only by the gates 196 on the inner side edge of the control slot, lug 39 only by the gates 198 on the outer side edge.

Figure 12:
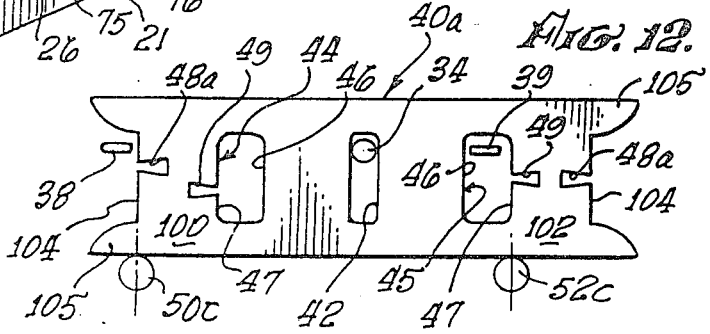
FIG. 12 is a schematic plan representing a modified form of single tumbler.

FIG. 12 illustrates somewhat schematically a further modification of the first described embodiment. As before, tumblers 40*a* are guided by the fixed pin 34 working in the transverse guide slots 42, and the bolt movement is controlled by the fence lugs 38 and 39 which cooperate with gated blocking edges on the tumblers. The gates, however, in the present structure may be described as being formed in the outer and inner edges of the two transverse bridge portions 100 and 102 of the tumblers, rather than in the inner and outer side edges of the respective control slots 44 and 45, as before. From another viewpoint, the gates 49, which control fence lug 39, are formed in the outer side edges 47 of the control slots, as before, but the gates 48*a* for lug 38 are formed in the end edges 104 of the tumbler. Thus the inner side edges 46 of the control slots are free of their previous function, and can be given any convenient shape.

Key noses for tumblers 40*a* are preferably placed in the previously described relation to their respective gated blocking edges; that is, with key nose 50*c* in line with the forward or lefthand end 104 of the tumbler, and with key nose 52*c* in line with the rearward or righthand side edge 47 of control slot 45. The lateral sides of the tumblers may be extended beyond the drive edges 104, as indicated typically at 105, to insure adequate driving contact for the key in nose 50*c*. Operation of the modified tumblers is then in principle as has been described. The embodiments of FIGS. 10 and 11 may be modified in corresponding manner, as will be evident without specific illustration.

It will be understood that many further modifications may be made in the illustrative configurations described herein without departing from the proper scope of the invention. For example, it is sometimes convenient to make all required key changes by inverting certain ones of the tumblers, retaining other tumblers always in a predetermined orientation in the lock. Under that condition the tumblers that are not inverted may be of somewhat simplified form, as by omitting gates and accurately finished driving edges that are not needed. Under that condition, the tumblers that are not to be inverted are preferably arranged at the bottom of the stack.

As a further example, it is sometimes useful to provide single key locks which are interchangeable with dual key locks of a particular design. The structures already described are well adapted for that purpose. To convert the present locks to single key operation key nose 52 and its collar 65 (FIG. 1) can be omitted, for example, together with fence lug 39. In embodiments based on FIGS. 10 and 11 the rearward tumbler stack is also omitted. In the forms of the invention with a single tumbler stack, a fixed pin is typically substituted for the omitted nose core to support all the tumblers at their rearward ends at any selected uniform level. Operation of a key in nose 50 then aligns the corresponding gates correctly, unblocking fence lug 38 and releasing the bolt despite absence of the second key.

I claim:

1. A lock which includes bolt means movable along a bolt axis between a locking position and a releasing position and including fence means, at least one set of flat tumblers, means for mounting the tumblers for independent movement transversely of the bolt axis, a gated blocking edge on each tumbler for cooperation with the fence means to normally block bolt movement toward releasing position, and key receiving means for controlling said tumbler movement to align the gates and unblock the bolt movement; said lock being further characterized in that at least a plurality of said tumblers include a second gated blocking edge facing oppositely to the first said edge, and said plurality of tumblers have such form that they are receivable by said mounting means in two alternative orientations with a different one of the blocking edges in position in each of the orientations to cooperate with the fence means under key control.

2. A lock according to claim 1 further characterized in that said key receiving means includes two key noses, said fence means includes two fence lugs, and each of said plurality of tumblers includes two further oppositely facing blocking edges in such positions that, in said alternative tumbler orientations, pairs of blocking edges cooperate with the respective fence lugs under control of keys in the respective key noses.

3. A lock according to claim 2 further characterized in that each said blocking edge, when in position to cooperate with a fence lug, is offset from the associated key nose in a direction substantially perpendicular to the bolt axis.

4. A lock according to claim 2 wherein the blocking edges of each of said plurality of tumblers are formed as the opposite side edges of two slots which are generally perpendicular to the bolt axis and are mutually spaced longitudinally of the bolt axis, one edge of each slot cooperating with one of said fence lugs and the other edge of each slot cooperating with the other fence lug.

5. A lock according to claim 1 wherein the blocking edges of each of said plurality of tumblers are formed as the opposite side edges of a slot which is generally perpendicular to the bolt axis.

6. A lock according to claim 5 further characterized in that said plurality of tumblers have such symmetry that they are receivable by said mounting means in two further alternative orientations each of which is derivable from one of the first said orientations by tumbler inversion about an axis substantially perpendicular to each of said blocking edges.

7. A dual-key lock comprising bolt means movable along a bolt axis between a locking position and a releasing position and including first and second fence means mutually spaced longitudinally of the bolt axis and coupled to the bolt, first and second key noses laterally offset from the bolt axis and spaced longitudinally thereof, a plurality of flat elongated tumblers, means mounting the tumblers generally parallel to the bolt axis for lateral sliding movement in respective mutually parallel planes, said mounting means including means for longitudinally positioning the tumblers, each tumbler having such symmetry with respect to a transverse axis and with respect to a longitudinal axis that it is receivable by the mounting means in any one of four alternative orientations, each tumbler including, in each said orientation, two transverse gated blocking edges in position to cooperate with the respective fence means to normally block the bolt means from said releasing position, and two laterally facing drive edges operatively engageable by corresponding keys in the respective key noses to laterally position the tumblers to unblock the bolt means.

8. A lock which includes bolt means movable along a bolt axis between a locking position and a releasing position, a stack of elongated tumblers generally parallel to the bolt axis, and first and second key noses mounted on respective key axes laterally adjacent the tumblers and mutually spaced longitudinally thereof; further characterized in that each tumbler includes first and second transverse gated blocking edges which are offset from the respective first and second key axes in directions substantially perpendicular to the bolt axis, the bolt means includes first and second fence means for cooperating with the set of first blocking edges and the set of second blocking edges, respectively, to normally block the bolt from said releasing position, the gates of each edge set being alignable to unblock the associated fence means by operation of a corresponding key in the associated key nose independently of a key in the other key nose.

9. A lock according to claim 8 wherein each one of at least a plurality of said tumblers includes key--engaging surfaces on both lateral edges of the tumbler longitudinally positioned for cooperation with keys in the respective key noses, whereby such tumblers are operable in the lock in alternative orientations which differ by inversion about a longitudinal axis.

10. A lock according to claim 9 wherein at least one gate on each of said plurality of tumblers is differently spaced from the associated key-engaging surfaces on the opposite tumbler edges, whereby inversion of such tumbler about a longitudinal axis alters the combination of bit levels for the two keys.

11. A lock according to claim 8 wherein each one of at least said plurality of tumblers includes a second pair of first and second blocking edges which face oppositely to said first pair and which cooperate with the respective first and second fence means when the tumbler is reversed end for end in the lock.

12. A set of flat, elongated tumblers adapted to be mounted in a lock, each tumbler having a longitudinal axis and including a guide slot perpendicular to the axis for slidingly receiving a fixed guide member, two transverse control slots for spacedly receiving respective fence means coupled to a lock bolt, said control slots being equally spaced on opposite sides of the guide slot and having gate recesses in both side edges in selected positions for cooperating with the respective fence means.

13. A tumbler set according to claim 12 wherein each tumbler includes four laterally facing surface areas adapted for key engagement and positioned symmetrically with respect to the axis and with respect to the guide slot.

14. A lock according to claim 1 further characterized in that said key receiving means includes two key noses, said fence means includes two fence lugs, and each of said plurality of tumblers has such form that it is receivable by said mounting means alternatively in one orientation with one of said gated blocking edges in position to cooperate with one of said fence lugs under control of one of said key noses, and in another orientation with the other gated blocking edge in position to cooperate with the other fence lug under control of the other key nose.

15. A lock according to claim 14 wherein said mounting means includes means for supporting the tumblers in two stacks for translational movement transversely of the bolt axis.

16. A lock according to claim 14 wherein said mounting means includes means for supporting the tumblers in two stacks for swinging movement about respective pivot axes, said key control causing tumbler swinging movement in opposite directions in the two stacks.

* * * * *